US005399938A

United States Patent [19]

Choi

[11] Patent Number: 5,399,938

[45] Date of Patent: Mar. 21, 1995

[54] ANODE ASSEMBLY FOR A MAGNETRON COVERED BY AN OXYGEN FREE COPPER FILM

[75] Inventor: Byung T. Choi, Kyungsangbuk-do, Rep. of Korea

[73] Assignee: Goldstar Co., Ltd., Seol, Rep. of Korea

[21] Appl. No.: 986,468

[22] Filed: Dec. 7, 1992

[30] Foreign Application Priority Data

Dec. 13, 1991 [KR] Rep. of Korea ..... 22939/1991

[51] Int. Cl.[6] ..... H01J 25/50

[52] U.S. Cl. ..... 315/39.75; 315/39.51

[58] Field of Search ..... 315/39.51, 39.75; 313/306, 243

[56] References Cited

FOREIGN PATENT DOCUMENTS 4945618 12/1974 Japan .

183938 7/1990 Japan ..... 315/39.75

*Primary Examiner*—Benny T. Lee

*Attorney, Agent, or Firm*—Denton L. Anderson

[57] ABSTRACT

This invention relates to an anode assembly for a magnetron used to generate microwaves in a microwave oven. An object of the invention is to inexpensively prevent the generation of gas due to impurities within the active space within the anode assembly. Such gas can interfere with the movement of thermally excited electrons within the active space and thereby cause abnormal oscillation of the microwave energy output. In the invention, the surfaces of the magnetron's hollow anode cylinder and plate-shaped anode vanes are made of electrical-grade copper with a coating of oxygen-free copper having an extremely low impurity content.

4 Claims, 4 Drawing Sheets

ANODE ASSEMBLY FOR A MAGNETRON COVERED BY AN OXYGEN FREE COPPER FILM

BACKGROUND OF THE INVENTION

1. Field of the Invention

This invention relates to an anode assembly for a magnetron used in a microwave oven, which is usually referred to as an electronic range, to generate microwaves for cooking foodstuffs contained in the oven.

2. Description of the Prior Art

Conventional magnetrons are illustrated in FIGS. 1 and 2 of the accompanying drawings. Such conventional magnetrons comprise a direct-heated filament (referred to as a cathode) 1 disposed axially at its central position and an anode cylinder (referred to as an anode) 2 which is an anode structure mounted in a radially outwardly spaced, in surrounding relation to the cathode.

In addition, the magnetron includes a magnetic circuit comprising a magnet 4 (see FIG. 1) and a magnetic pole 5 and provided within a yoke 3 (see FIG. 1) serving as a frame, to apply a magnetic flux into an active space 12 defined between the filament 1 and the anode cylinder 2; an output section comprising an antenna lead 6, an antenna seal 7, an ceramic insulator 8 and an antenna cap 9 (see FIG. 1) for emitting microwave energy transferred from the anode cylinder 2 to the exterior of the magnetron; radiation fins 11 (see FIG. 1) for radiating heat resulting from collision of thermally excited electron with a plurality of vanes 10 disposed radially on the inner periphery of the anode cylinder; and a filter circuit for preventing an unnecessary high frequency component produced in the active space 12 from flowing back to a power source.

When the magnetron thus constructed performs oscillating operation, the thermally excited electron emitted from the filament 1 effect cycloidal movement as they undergo the force of an electric field induced between the vanes 10 and the filament 1 and the magnetic flux applied into the active space 12 between the vanes 10 and the filament 1 and the magnetic flux applied into the active space 12 between the filament and the anode cylinder by the magnetic pole 5 of the magnetic circuit. The thermally excited electron thus accelerated generate the microwave energy which will be received by the vanes 10. The microwave energy transferred to the vanes is emitted through the antenna lead 6 of the output section to the exterior of the magnetron to dielectrically heat and cook the foodstuffs placed within the microwave oven.

The anode cylinder 2 and the anode vanes 10 constituting the anode assembly for the magnetron are made entirely of an expensive material having extremely low impurity content, such as oxygen-free copper. However, use of the expensive oxygen-free copper for making the anode cylinder 2 and the anode vanes 10 causes increase of the cost of the magnetron, while the electrical-grade copper used for the parts results in generation of gas due to a small quantity of the impurities emitted into the active space of the anode assembly. The gas may interfere with the movement of the thermally excited electron, thereby causing abnormal oscillation or a moding phenomenon in which a pattern of the microwave mode in the active space is not maintained constantly.

SUMMARY OF THE INVENTION

With the foregoing drawbacks of the prior art in view, it is an object of the present invention to provide an anode assembly for a magnetron, which is capable of preventing abnormal oscillation of the magnetron at a low cost by forming an anode cylinder and anode vanes, all of which are made of electrical-grade copper, and then plating their outer surfaces with oxygen-free copper.

To achieve the above object, there is provided according to one form of the present invention an anode assembly for a magnetron, comprising an anode cylinder for receiving thermally excited electron emitted from a filament to generate microwave energy; and a plurality of a radially extending anode vanes disposed on the inner periphery of the anode cylinder, the entire surfaces of the anode cylinder and the anode vanes being formed with a coating film of oxygen-free copper.

BRIEF DESCRIPTIONS OF THE DRAWINGS

DESCRIPTION OF THE PREFERRED EMBODIMENT

Figure 1:
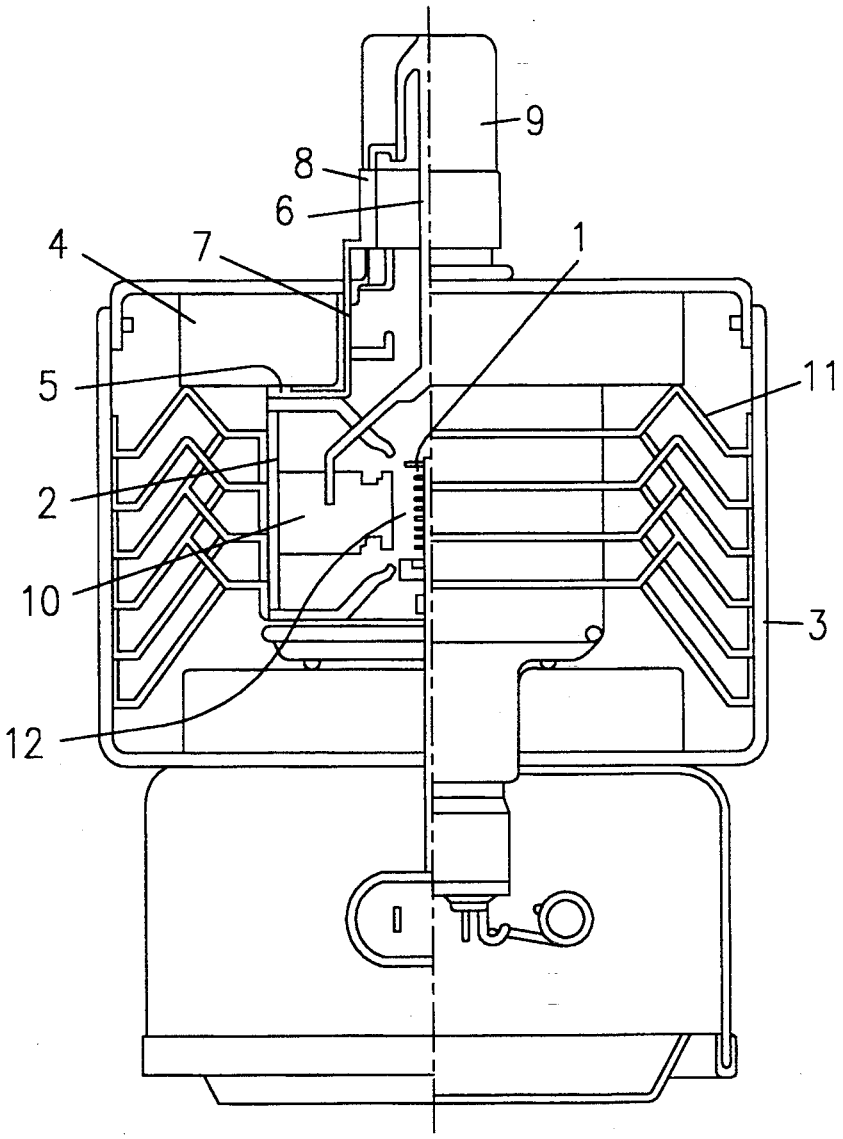
FIG. 1 PRIOR ART
FIG. 1 is a cross-sectional view of a conventional magnetron according to the prior art.
Figure 2:
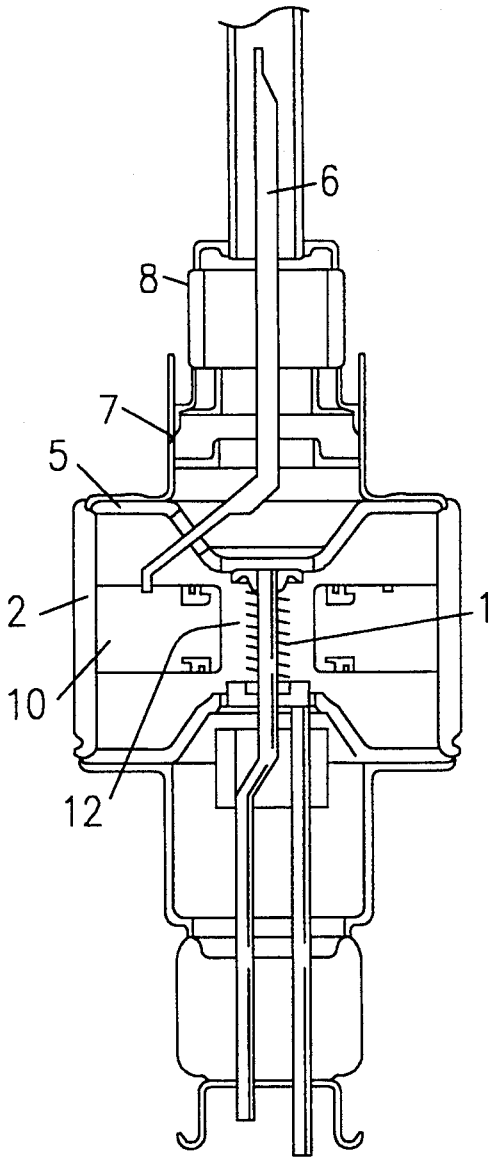
FIG. 2 PRIOR ART
FIG. 2 is a cross-sectional view of a portion of a second conventional magnetron according to the prior art.
Figure 3:
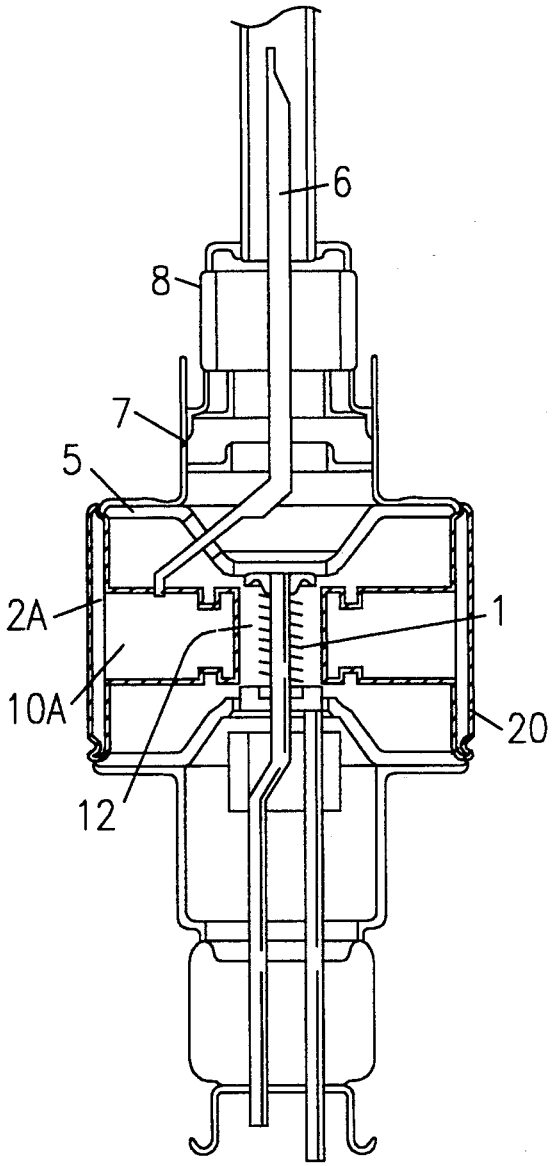
FIG. 3 is a cross-sectional view showings an anode assembly for a magnetron according to the present invention.
Figure 4:
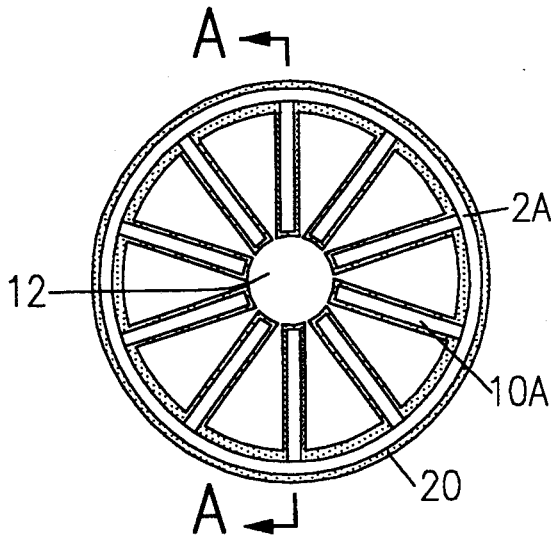
FIG. 4 is a plan view of the anode assembly of the present invention.
Figure 5:
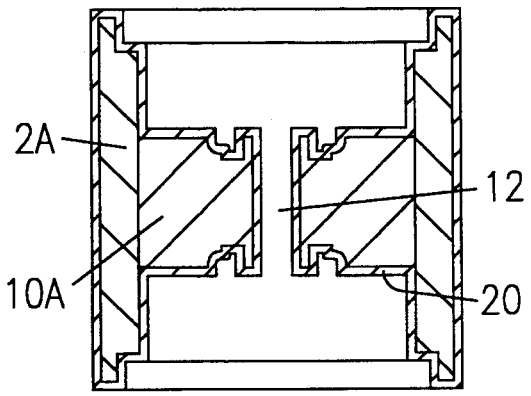
FIG. 5 is a cross-sectional view taken along line A—A of FIG. 4.

The invention will now be described in detail, by way of example, with reference to FIGS. 3 to 5 of the accompanying drawings, in which FIG. 3 is a longitudinal cross-sectional view of a portion of a magnetron provided with an anode assembly according to the present invention, FIG. 4 is a plan view of the anode assembly of the present invention, and FIG. 5 is a cross-sectional view taken along line A—A of FIG. 4.

The magnetron according to the present invention is identical in general construction with that of the prior art with the exception of the structure of the anode assembly. Therefore, throughout the following description parts similar to those of the prior art are denoted by similar reference numerals and the detailed description for the parts is omitted herein to avoid the duplication of explanation.

As shown in FIGS. 3 to 5, the anode assembly for the magnetron according to the present invention comprises an anode cylinder 2*a* and a plurality of radially extending anode vanes 10*a* disposed on the inner periphery of the anode cylinder. The anode cylinder 2*a* and the anode vanes 10*a* are separately made of electrical-grade copper, and then joined together to form the anode assembly. Then, the outer surface of the assembly is plated with oxygen-free copper 20 by a predetermined thickness. Alternatively, the anode cylinder and the anody vanes, all of which are made of electrical-grade copper, may be separately plated with the oxygen-free copper, and then joined together.

With this construction, when the magnetron according to the present invention performs oscillating operation, the thermally excited electron emitted from a filament 1 effect cycloidal movement as they are subjected to the force of an electric field induced between the filament and the vanes 10*a* and a magnetic flux applied into an active space 12 between the filament and the anode cylinder 2*a* by a magnetic pole 5 of a magnetic circuit. The thermally excited electron thus accelerated generate microwave energy which will be received by the vanes 10*a*. At this time, generation of gas due to impurities in the active space 12 being under a vacuum condition can be prevented because of the layers of the oxygen-free copper 20 substantially free of impurity content plated on the surfaces of the anode cylinder 2*a* and the anode vanes 10*a*. As a result, a pattern of the frequency mode in the active space can be maintained constantly so that exact oscillation of the magnetron can be accomplished.

Further, according to the present invention, since the anode cylinder and the anode vanes are not made entirely of expensive oxygen-free copper, but plated on only the surfaces with such oxygen-free copper, increase of the costs of the parts may be prevented.

Although the present invention has been described with reference to the particular embodiment in which the anode cylinder 2*a* and the anode vanes 10*a* are plated with oxygen-free copper, it is not limited to that precise embodiment, and it is also possible to employ other suitable material of low impurity content, which permits the vacuum condition in the active space to be maintained satisfactorily.

From the foregoing it will be appreciated that according to the present invention the vacuum condition in the active space can be excellently maintained by the construction of the anode assembly made of electrical-grade copper and plated with oxygen-free copper of low impurity content, so that exact oscillation of the magnetron can be provided and a reduction in costs can be achieved.

While the invention has been shown and described with particular reference to a preferred embodiment thereof, it will be understood that variations and modifications may be made therein without departing from the spirit and scope of the invention as defined in the appended claims.

What is claimed is:

1. An anode assembly for a magnetron which generates microwave energy, the anode assembly comprising an anode cylinder having an inner periphery, a filament and a plurality of radially extending anode vanes disposed on the inner periphery of said anode cylinder, the anode cylinder being in surrounding relation to the filament, said anode cylinder and said anode vanes having respective outer surfaces entirely covered by a coating of film of oxygen-free copper.

2. An anode assembly for a magnetron as claimed in claim 1, in which said anode cylinder and said anode vanes are composed substantially entirely of electric-grade copper.

3. A method for making a magnetron having an anode cylinder with an inner periphery, a filament and a plurality of radially extending anode vanes disposed on the inner periphery of the anode cylinder, the anode cylinder being in surrounding relation to the filament, the anode cylinder and the anode vanes having respective outer surfaces, the method comprising the steps of forming the anode cylinder and the anode vanes from a material with an impurity content higher than that of oxygen-free copper and then coating the outer surfaces of the anode cylinder and the anode vanes with a film of oxygen-free copper.

4. A method for making a magnetron as claimed in claim 3, wherein the steps of forming the anode cylinder and the anode vanes comprise forming the anode cylinder and the anode vanes from electrical-grade copper.

* * * * *